US009527295B1

(12) United States Patent
Tamarez Gomez et al.

(10) Patent No.: US 9,527,295 B1
(45) Date of Patent: Dec. 27, 2016

(54) MULTIPURPOSE BOTTLE APPARATUS AND BOTTLE LOADING MECHANISM AND METHOD

(71) Applicant: XEROX CORPORATION, Norwalk, CT (US)

(72) Inventors: Frank B. Tamarez Gomez, Rochester, NY (US); Timothy P. Foley, Marion, NY (US); Mark A. Adiletta, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/831,857

(22) Filed: Aug. 20, 2015

(51) Int. Cl.
*B41J 2/175* (2006.01)
*B41J 2/18* (2006.01)

(52) U.S. Cl.
CPC ..... *B41J 2/175* (2013.01); *B41J 2/17509* (2013.01); *B41J 2/17506* (2013.01); *B41J 2/18* (2013.01)

(58) Field of Classification Search
CPC ..... B41J 2/175; B41J 2/17509; B41J 2/18; B41J 2/17503; B41J 2/17506
See application file for complete search history.

(56) References Cited

U.S. PATENT DOCUMENTS 4,288,007 A * 9/1981 Rogers ..... B67D 3/00 141/376
2005/0151802 A1* 7/2005 Neese ..... B41J 2/17513 347/85
2012/0262520 A1* 10/2012 Baldwin ..... B41J 2/17593 347/56

* cited by examiner

*Primary Examiner* — Manish S Shah
*Assistant Examiner* — Yaovi M Ameh
(74) *Attorney, Agent, or Firm* — Ronald E. Prass, Jr.; Prass LLP

(57) ABSTRACT

A spill proof, user-friendly dispensing system that protects users from exposure to toxic fluids (e.g., Ethylene Glycol used in MICR ink) includes a bottle loading mechanism for feeding ink or other fluids to a respective supply tank of an image forming device, and a quick connect gravity feed multipurpose bottle apparatus. Ink replenishing bottles can be inserted upright into holder of the bottle loading mechanism, connected to a supply tank, and folded back out-of-the-way in a dispensing position. The bottle may be rotated from a gravity feed position to a rotated position for removal and installation while the bottle remains in the holder. The bottle when empty may be used to collect waste from the image forming device.

7 Claims, 5 Drawing Sheets

MULTIPURPOSE BOTTLE APPARATUS AND BOTTLE LOADING MECHANISM AND METHOD

CROSS-REFERENCE TO RELATED APPLICATIONS

The disclosure is related to U.S. patent application Ser. No. 14/831,846, concurrently filed herewith on Aug. 20, 2015, titled "Multipurpose Bottle Apparatus and Bottle Loading Mechanism and Method," the disclosure of which is incorporated herein by reference in its entirety.

BACKGROUND OF THE INVENTION

Digital inline printing and processing of continuous web of media (e.g., paper) has become ubiquitous in recent years for a variety of purposes, including publishing, "print-on-demand," direct mail marketing, billing etc. In order to keep up with the ink supply demands of continuous web printers, ink reservoirs having large quantities of ink are arranged external to internal ink jet cartridges. The external ink reservoirs are connected to the ink supply containers of the ink jet cartridges to feed ink to the supply containers of the cartridges when ink is printed out of the print heads of the printer. However, known systems suffer from their relatively high complexity and cost.

The complexity and cost further increases when dealing with the commercial banking industry, where the printer produces checks or financial documents with magnetic ink, i.e., by fusing magnetically loaded toner particles thereon. Each financial document has imprinted thereon encoded data in a Magnetic Ink Character Recognition (MICR) format. Unfortunately MICR ink can cause skin irritation, at least due to Ethylene Glycol content in the ink. Ethylene Glycol is toxic, and when oxidized turns to glycolic acid and oxalic acid. According to the annual report of the American Association of Poison Control Centers' National Poison Data System in 2007, there were about 1000 reported cases of ethylene glycol poisoning resulting in 16 deaths. Thus, it is beneficial to prevent human contact with the ink or with fumes coming from the ink in an economical and safe printing system.

BRIEF SUMMARY OF THE INVENTION

This summary is provided to introduce a selection of concepts in a simplified form that are further described below in the detailed description. This summary is not intended to identify essential features of the claimed subject matter, nor is it intended for use in determining the scope of the claimed subject matter.

According to aspects illustrated herein, there is provided an exemplary quick connect gravity feed multipurpose bottle apparatus in a printer liquid delivery system useful for supplying a liquid useful in printing including a printer liquid replenishing bottle, a first quick connect fitting, and a second quick connect fitting. The printer liquid replenishing bottle is configured to supply liquid to a liquid supply tank of an image forming device to maintain a level of the liquid contained in the liquid supply tank predetermined to ensure a continuous supply of liquid to print heads of the image forming device. The printer liquid replenishing bottle has an enclosed reservoir configured to house the liquid and a closure sealingly coupled to the reservoir, with the closure having a first port and a second port separate from the first port. The first quick connect fitting is sealingly connected to the first port of the closure, with the first quick connect fitting configured for fluid communication with the liquid supply tank of the inkjet image forming device to allow egress of the liquid from the printer liquid replenishing bottle to the liquid supply tank. The second quick connect fitting is sealingly connected to the second port of the closure, with the second quick connect fitting configured to allow fluid ingress only into the printer liquid replenishing bottle without fluid flow through the liquid housed in the printer liquid replenishing bottle.

According to aspects illustrated herein, there is provided in an ink delivery system a liquid useful in printing to a liquid supply tank of an image forming device, an exemplary bottle loading mechanism including a support frame and a rack attached to the support frame. The rack includes a bottle holder configured to secure a printer liquid replenishing bottle thereto, with the printer liquid replenishing bottle designed for storing liquid therein. The rack is configured to rotate the printer liquid replenishing bottle from a first position upright with a closure of the printer liquid replenishing bottle at the top of the printer liquid replenishing bottle to a second position upside down with the closure at the bottom of the printer liquid replenishing bottle to drain the liquid from the printer liquid replenishing bottle via the closure to the supply tank. The liquid may be an ink, a surfactant, a lubricant, a cleaning liquid, a toxic liquid, and toxic fume emitting liquid.

The exemplary embodiments also include a method in an ink delivery system for supplying a liquid useful in printing to a liquid supply tank of an image forming device, with the printer liquid delivery system including a bottle loading mechanism having a support frame and a rack attached to the support frame, the rack including a bottle holder configured to secure a printer liquid replenishing bottle thereto. An exemplary method includes securing the printer liquid replenishing bottle to the bottle holder with the printer liquid replenishing bottle storing the liquid and air therein, rotating the bottle holder to move the printer liquid replenishing bottle from a first position upright with a closure of the printer liquid replenishing bottle at the top of the printer liquid replenishing bottle to a second position upside down with the closure at the bottom of the printer liquid replenishing bottle, with the liquid stored in the printer liquid replenishing bottle in the second position having a body and a top layer in direct contact with the air in the printer liquid replenishing bottle, transferring liquid from the printer liquid replenishing bottle via the closure to the liquid supply tank, and replacing the liquid transferred from the printer liquid replenishing bottle by introducing ambient air to the air in the printer liquid replenishing bottle without direct contact of the ambient air into the body of liquid in the printer liquid replenishing bottle.

The exemplary embodiments further include a quick connect gravity feed multipurpose bottle apparatus useful for supplying a liquid useful in printing, with the gravity feed multipurpose bottle apparatus including a closure for a printer liquid replenishing bottle, a first quick connect fitting and a second quick connect fitting. The closure is a cover having a first port and a second port separate from the first port, with the closure configured to sealingly cover the opening of a printer liquid replenishing bottle configured to supply the liquid to a liquid supply tank of an image forming device to maintain a predetermined level of the liquid contained in the liquid supply tank. The printer liquid replenishing bottle has a reservoir configured to house the liquid and sealable by the closure when the closure is coupled to the reservoir. The first quick connect fitting may be sealingly connected to the first port of the closure, with the first quick connect fitting configured for fluid communication with the liquid supply tank of the image forming device to allow egress of the liquid from the printer liquid replenishing bottle to the liquid supply tank. The second quick connect fitting may be sealingly connected to the second port of the closure, with the second quick connect fitting configured to allow fluid ingress only into the printer liquid replenishing bottle without fluid flow through the liquid housed in the printer liquid replenishing bottle.

The exemplary embodiments yet further include a method of supplying a liquid useful in printing. The method may include providing a closure having a first port and a second port separate from the first port, with the closure configured to sealingly cover an opening of a printer liquid replenishing bottle configured to supply liquid to a liquid supply tank of an image forming device to maintain a predetermined level of the liquid contained in the liquid supply tank. The printer liquid replenishing bottle has a reservoir configured to house the liquid and sealable by the closure when the closure is coupled to the reservoir. The method may also include attaching a first quick connect fitting to the first port of the closure to form a sealing connection there between, with the first quick connect fitting configured for liquid communication with the liquid supply tank of the image forming device to allow egress of the liquid from the printer liquid replenishing bottle to the liquid supply tank. The method may further include attaching a second quick connect fitting to the second port of the closure to form a sealing connection there between, with the second quick connect fitting configured to allow fluid ingress only into the printer liquid replenishing bottle without fluid flow through liquid housed in the printer liquid replenishing bottle. The method may still further include moving the printer liquid replenishing bottle to a position with the closure at the bottom of the printer liquid replenishing bottle, with the liquid stored in the printer liquid replenishing bottle in the second position having a body and a top layer in direct contact with the air in the printer liquid replenishing bottle, transferring liquid from the printer liquid replenishing bottle via the closure to the liquid supply tank, and replacing the liquid transferred from the printer liquid replenishing bottle by introducing ambient air to the air in the printer liquid replenishing bottle without direct contact of the ambient air into the body of liquid in the printer liquid replenishing bottle.

The exemplary embodiments still further include a method of refilling a quick connect gravity feed multipurpose bottle apparatus having a printer liquid replenishing bottle emptied of liquid, the printer liquid replenishing bottle having an enclosed reservoir configured to house the liquid and a closure sealingly coupled to the reservoir, the closure having a first port and a second port separate from the first port, a first quick connect fitting sealingly connected to the first port of the closure, the first quick connect fitting configured for liquid communication with a liquid supply tank of the image forming device to allow egress of the liquid from the printer liquid replenishing bottle to the liquid supply tank, and a second quick connect fitting sealingly connected to the second port of the closure, the second quick connect fitting integral with a one-way valve configured to allow fluid ingress only into the printer liquid replenishing bottle without fluid flow through the liquid housed in the printer liquid replenishing bottle. The exemplary method includes disconnecting the one-way valve from the closure, attaching the first quick connect fitting to a liquid source storing the liquid, refilling the bottle with the liquid from the liquid source via the first quick connect fitting, disconnecting the first quick connect fitting from the liquid source, and attaching one of the one-way valve and another one-way valve to the second quick connect fitting.

The exemplary embodiments yet still further include a printer liquid delivery system for supplying a liquid useful in printing that may include a liquid supply tank, a printer liquid replenishing bottle, a closure of the bottle, first and second quick connect fittings, and a conduit. The liquid supply tank is configured to provide a liquid to an image forming device. The closure has a first port and a second port separate from the first port, with the closure configured to sealingly cover the opening of a printer liquid replenishing bottle configured to supply the liquid to the liquid supply tank to maintain a predetermined level of the liquid contained in the liquid supply tank. The printer liquid replenishing bottle includes a reservoir configured to house the liquid and sealable by the closure when the closure is coupled to the reservoir. The first quick connect fitting is sealingly connected to the first port of the closure. The conduit is directly or indirectly attached between the first quick connect fitting and the liquid supply tank to allow egress of the liquid from the printer liquid replenishing bottle to the liquid supply tank. The second quick connect fitting is sealingly connected to the second port of the closure, the second quick connect fitting configured to allow fluid ingress only into the printer liquid replenishing bottle without fluid flow through the liquid housed in the printer liquid replenishing bottle.

The exemplary embodiments may include a vent tube attached to the second quick connect fitting and extending into the printer liquid replenishing bottle, with the tube having a distal aperture adjacent the bottom wall of the enclosed reservoir. The vent tube may be coupled to a one-way valve configured for fluid ingress only into the printer liquid replenishing bottle. The bottle loading mechanism may be configured to rotate the printer liquid replenishing bottle from a first position upright with the closure at the top of the printer liquid replenishing bottle to a second position upside down with the closure at the bottom of the printer liquid replenishing bottle and configured to drain the printer liquid to the supply tank. The printer liquid replenishing bottle may be configured as a multi-purpose bottle having a first stage to feed the liquid to the image forming device, and a second stage to collect waste from the image forming device, with the first quick connect fitting configured for liquid supply during the first stage and air venting during the second stage, and the second quick connect fitting being configured for air venting during the first state and waste infeed during the second stage. A first conduit may extend from the first port and configured to provide fluid communication to the liquid supply tank, and a second conduit may extend from the second port and include a one-way valve. The printer liquid replenishing bottle may have indicia representing the fluid contents within the enclosed reservoir. The image forming device may be an ink-jet image forming device or a lithography image forming device. In addition, the liquid may be an ink, a surfactant, a lubricant, a cleaning liquid, a toxic liquid, and toxic fume emitting liquid.

Exemplary embodiments are described herein. It is envisioned, however, that any system that incorporates features of systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION OF THE INVENTION

The present invention will be illustrated in more detail with reference to the accompanying drawings, and which preferred embodiments of the invention are shown. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value.

Reference is made to the drawings to accommodate understanding of media marking devices, including ink-jet, lithography or other image forming devices or printing systems, which may include direct or offset printing of images. Ink delivery systems for feeding ink to a supply tank of an ink image forming device are discussed to provide an example of an advantageous use for a bottle loading mechanism for feeding ink to an ink supply tank, and for a quick connect gravity feed multipurpose bottle apparatus in accordance with embodiments. Bottle loading mechanisms and gravity feed multipurpose bottle apparatuses are useful for other applications, including lithographic or other printing applications in addition to ink image formation systems as described herein by way of example.

Figure 1:
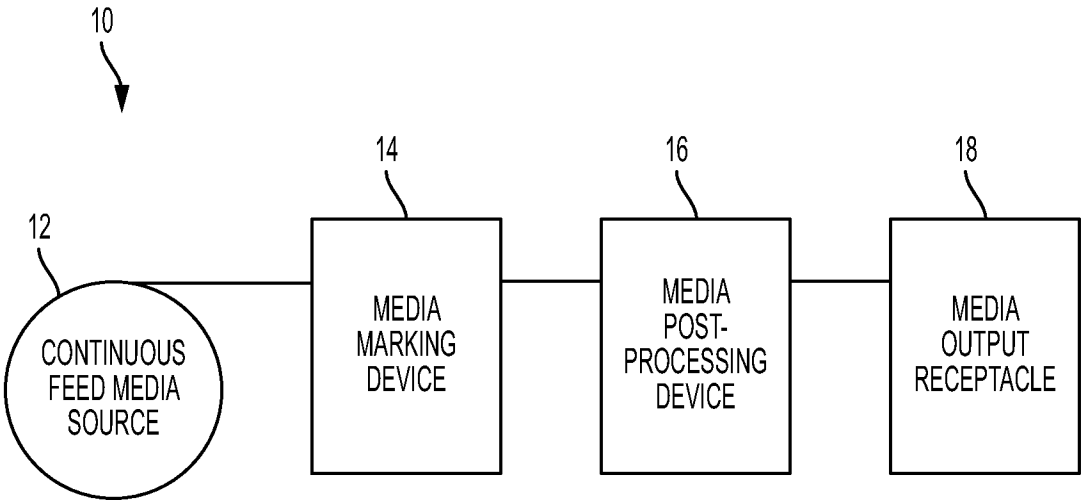
FIG. 1 illustrates a block diagram of a general configuration of an image forming system that employs continuous feed or web material as an image receiving media substrate.

Many modern, sometimes complex, image forming systems make use of continuous feed or web material image receiving media, which is fed from rolls or stacks as image receiving media sources. FIG. 1 illustrates a block diagram of a general configuration of an image forming system 10 that employs continuous feed or web material image receiving media. A roll of web material image receiving media 12 is provided as an image receiving media source. Images are printed on the continuous feed or web material image receiving media in particular page layouts, for example, according to instructions from an image production source (not shown) by an image forming or media marking device 14.

Media marking or image forming devices, as those devices may be referenced throughout this disclosure, are not intended to be devices that are restricted to employment of any particular media marking materials, e.g., inks, toners and the like, or to any particular delivery mechanisms for those media marking materials, including but not limited to, xerographic image forming, inkjet delivery, laser marking, lithographic ink delivery or the like. Further, the media marking or image forming devices described in this disclosure may include initial image finishing components, e.g., fuser modules for fusing and/or fixing the delivered media marking materials on the surfaces of the image receiving media substrates by heat, pressure, or a combination of the two. It should be recognized, however, that the initial image finishing components may be separate, stand-alone devices or may be incorporated as portions of other media post-processing devices 16.

The media marking device 14 may be an inkjet image forming device having ink supply tanks (e.g., ink cartridges, ink containers) each housing a respective color or type of ink (e.g., black, cyan, magenta, yellow, Magnetic Ink Character Recognition (MICR)) or coating liquid for delivery to a print head. In order to minimize problems associated with low ink levels in the supply tanks, the supply tanks may be replenished as needed with ink from ink replenishing bottles, for example, via conduits and bulk ink supply feed pumps interconnected between the respective supply tanks and ink replenishing bottles or reservoirs, as well understood by a skilled artisan.

Extra care should be taken with printer liquid replenishing bottles or reservoirs to avoid skin contact with the liquid. For example, ethylene glycol content in MICR ink can cause skin irritation and damage. A gravity feed multipurpose bottle apparatus as exemplified herein may help avoid skin contact with the printer ink. The bottle apparatus includes a quick connect ink replenishing bottle, and may be a part of the media marking device 14 or in fluid communication with the media marking device, for example, by conduits coupled to the supply tanks of the media marking device.

Downstream, in a process direction, of the media marking device 14 may be one or more media post-processing devices 16 for executing post-processing on the now-imaged continuous feed or web material image receiving media prior to forwarding a finished printed document to a media output receptacle 18 for recovery by a user. The post-processing carried out on the media by the post-processing devices 16 can involve one or more of numerous methodologies that are implemented for document finishing. For example, the media post-processing devices 16 may employ technologies for fixing images on the surfaces of the continuous feed or web material image receiving media, or may separately provide, for example, cutting, collating, stacking, sorting, binding and/or stapling of imaged image receiving media substrates to form finished documents. The media post-processing devices 16 may, for example, cut individual pages from the continuous feed or web material image receiving media, and stack and collate those pages, and drill and bind those pages, as a finished output document.

Figure 2:
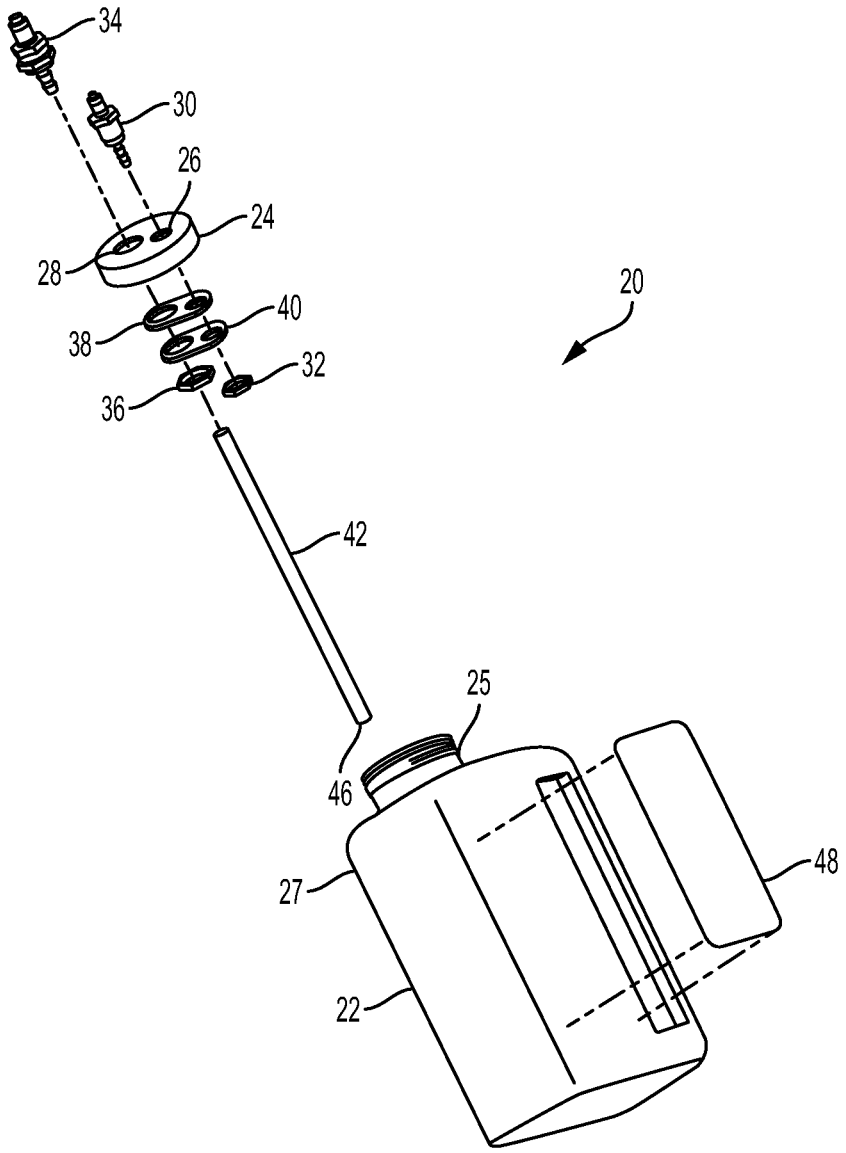
FIG. 2 shows a quick connect gravity feed multipurpose bottle apparatus in exploded view in accordance with an exemplary embodiment.

FIG. 2 depicts a quick connect gravity feed multipurpose bottle apparatus 20 in exploded view in accordance with an exemplary embodiment. The bottle apparatus 20 may be used with an ink delivery system for feeding ink from the bottle apparatus to an image forming device (e.g., media marking device 14) as will be described in greater detail below. The bottle apparatus 20 may also be used with an ink and/or other fluid delivery system for feeding fluid (e.g., flushing fluid) from the bottle apparatus to the image forming system 10. Without being limited to a particular theory, the ink delivery system may have a bottle loading mechanism for holding and activating the bottle apparatus to feed ink to an ink supply tank (FIGS. 3 and 4) of an image forming device via gravity, conduits and bulk ink supply tank pumps as well understood by a skilled artisan. When sealed (FIG. 3) the bottle apparatus is leak resistant, preferably at least up to about 2.2 pounds per square inch. As such, the sealed bottle may support a 160 pound person.

The bottle apparatus 20 includes an ink replenishing bottle 22 intentionally designed to supply a printer liquid (e.g., ink, surfactant, lubricant, cleaning fluid) to a liquid supply tank (e.g., ink supply tank, ink cartridge, surfactant container, lubricant container, cleaning supply container) of the image forming device to maintain a level of ink contained in the supply ink tank predetermined to continuously provide ink to the print head of the image forming device as needed for high quality image formation. The ink replenishing bottle 22 is preferably a plastic container that may have a fluid capacity of between a quart and a gallon. More preferably the bottle may have a fluid capacity of about half a gallon, although the dimensions or capacity of the bottle are not limited to any particular size or amount. The ink replenishing bottle 22 is a printer fluid replenishing bottle that may communicate printer liquids (e.g., ink, surfactant, lubricant, cleaning fluid) to the ink delivery system 10. Thus while the bottle 22 is generally referred to herein as an ink replenishing bottle, it is understood that the contents and use of the bottle is not limited by its referenced name.

As can best be seen in FIG. 2, the bottle 22 has a bottle neck 25 opening out to a main reservoir 27, with the bottle enclosable by a closure 24 (e.g., bottle cap, bottle top) preferably designed for sealing the bottle, for example via threaded engagement between the closure and neck of the bottle. The closure 24 may also include a liner to further prevent leakage between the closure and bottle. The closure includes a first port 26 and a second port 28 separate from the first port to allow fluid ingress and egress as described in greater detail below.

Inline with each port 26, 28 is a quick connect fitting that may be sealing connected to the respective port and prevent fluid leakage onto the exterior surfaces of the closure 24 and bottle 22 while allowing fluid flow into and out of the bottle 22 via an aperture extending through the quick connect fittings. The quick connect fittings may help prevent user contact with ink stored in the bottle 22, minimize spill, and provide easy serviceability. Further, the quick connect fittings are designed for use when the bottle 22 discharges ink to the ink supply tanks of a media marking device 14 and may be used after the bottle is emptied of ink as a waste container of waste fluid from the media marking device. The quick connect fittings may have opposing ends designed for easy attachment to various tubes, valves, and other conduits as understood by a skilled artisan for allowing fluid trespass there through as desired for operation of the bottle apparatus 20.

A first quick connect fitting includes a first insert 30 having a bore there through for fluid trespass. The first insert 30 may be extended through a first port 26 and coupled to a first locking nut 32 to sealingly attach the first quick connect fitting to the closure via the first port. Similarly, a second quick connect fitting includes a second insert 34 having a bore there through for fluid trespass. The second insert 34 may be extended through a second port 28 and coupled to a second locking nut 36 to sealingly attach the second quick connect fitting to the closure via the second port. Between the locking nuts and closure 24, a gasket 38 preferably made of an elastomer, but not limited thereto, may be attached to prevent leakage and minimize torque needed to provide a fluid seal. Further, a rigid plate 40 may be placed between the gasket 38 and locking nuts 32, 34 to add strength to the closure 24 and uniformly apply pressure to the gasket. While not being limited to particular sizes, the first insert 30 may be about a 3/16 inch fitting for supply ink egress or waste venting, the second insert 34 may be about a 1/4 inch fitting for gaseous (e.g., air) venting or waste infeed, the lock nuts 32 and 36 may be mating 3/16 inch and 1/4 inch lock nuts, the gasket may be about a 1/16 inch thick gasket and the rigid plate may be a stainless steel plate.

A vent tube 42 shown inline with the second insert 34 has a proximal end that can be attached to the second quick connect fitting. The vent tube 42 can extend from adjacent the second port into the ink replenishing bottle 22. Preferably the vent tube has a length that extends from its proximal end nearly to a bottom wall 44 (FIG. 3) of the bottle 22 to a distal end 46 of the vent tube adjacent the bottom wall of the ink replenishing bottle 22 when the closure is sealed onto the bottle. The vent tube 42 is shown as a separate conduit that may be attached to the second insert 34. Of course the vent tube may also be integral with the second insert or an extension of the second insert.

Still referring to FIG. 2, a label 48 may be placed on the ink replenishing bottle 22 with indicia of the contents within the bottle. For example, label 46 bearing indicia "INK MICR BLACK" may be attached to the bottle 22 via an adhesive there between. In other applications, the bottle 22 may be used to provide flushing fluid to the media marking device 14, or to receive waste (e.g., residual components of ink and web debris diluted or suspended in flushing fluid) from the media marking device. While not being limited to a particular theory, the label 48 may have multiple layers of indicia, with a top layer of indicia (e.g., INK MICR BLACK, Flushing Fluid) removable to display a lower or bottom layer of indicia (e.g., Waste Ink and Fluid) for associating the contents of the bottle with its current use. In another example a second label (e.g., Waste Ink/Fluid) could be attached to a first label (e.g., INK MICR BLACK, Flushing Fluid) when the bottle is emptied of ink and used for a second purpose associated with the second label.

Figure 4:
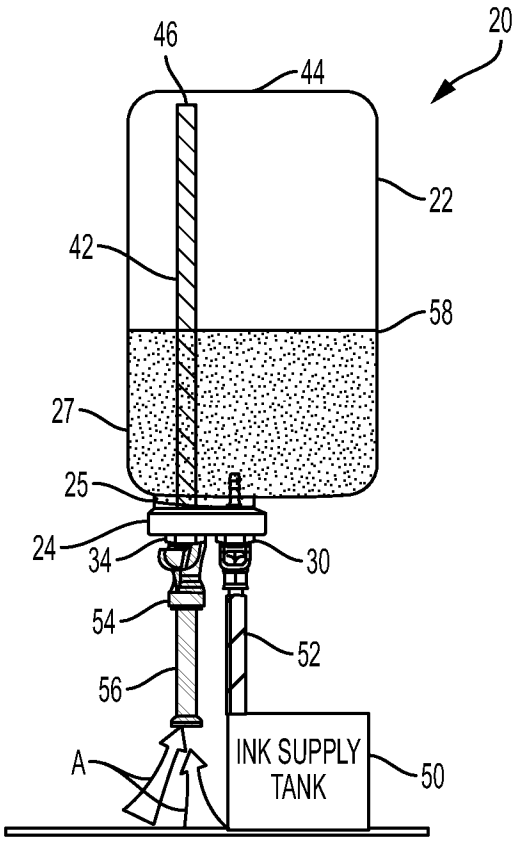
FIG. 4 is a partially sectional view of the quick connect gravity feed multipurpose bottle apparatus of FIG. 3 at a subsequent stage of ink transfer.
Figure 3:
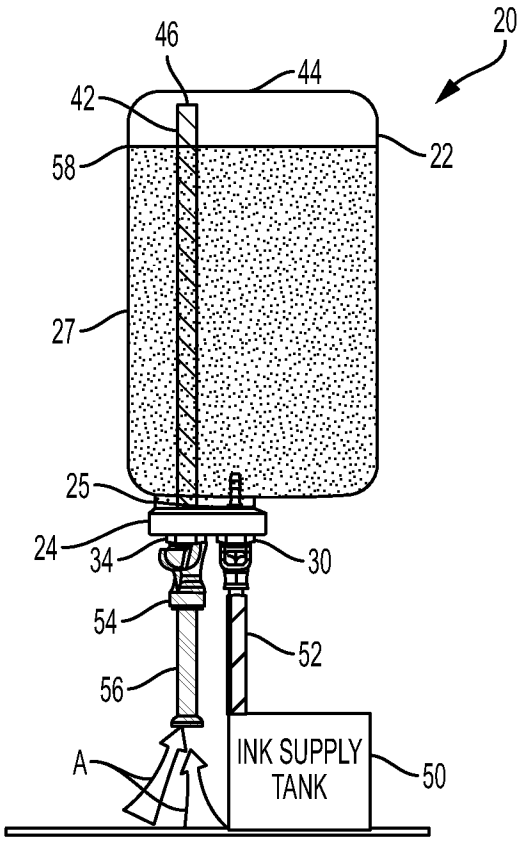
FIG. 3 is a partially sectional view of the quick connect gravity feed multipurpose bottle apparatus of FIG. 2 at an early stage of ink transfer.

FIGS. 3 and 4 depict the quick connect gravity feed multipurpose bottle apparatus 20 upside down partially in section with the closure 24 at the bottom of the ink replenishing bottle 22 and configured to drain ink from the bottle to an ink supply tank 50 of an image forming device. In particular, FIG. 3 depicts the ink replenishing bottle 22 at a stage where the bottle is nearly filled with the ink at the beginning of ink transfer, and FIG. 4 depicts the ink replenishing bottle at a subsequent stage when the bottle has less ink as the ink is being transferred to the ink supply tank 50 via a conduit 52 extending from the first quick connect fitting to the supply ink tank to provide liquid communication there between. The conduit 52 may be a separate member coupled to the first quick connect fitting (e.g., first insert 30), integral with the first quick connect fitting, or an extension of the fitting. The conduit 52 may also be integral with or an extension of the ink supply tank. It is understood that the ink supply tank 50 is merely illustrative of a container downstream of the ink replenishing bottle 22. The ink supply tank 50 is preferably part of the image forming device (e.g., media marking device 14) and in communication with print heads or other ink distributors that deposit the ink directly or indirectly onto the web or substrate.

Still referring to FIGS. 3 and 4, the second insert 34 of the second quick connect fitting is in fluid communication with a one-way valve 54 configured for fluid ingress only into the ink replenishing bottle. For example, the one-way valve 54 is designed to allow fluid (e.g., air A) into the vent tube 42 and block fluid egress out of the vent tube. The one-way valve 54 may be coupled to the second insert 34 directly or via a fluid conduit 56. Of course the one-way valve 54 may also be integral with the second insert or the conduit 56. In fact, all three of the second insert 34, the one-way valve 54 and the fluid conduit 56 may be integral or extensions of each other. Attached to the second insert 34 opposite the one-way valve 54, the vent tube 42 extends from its proximal end coupled to the second quick connect fitting nearly to the bottom wall 44 of the interior reservoir 27 of the ink replenishing bottle 22. The interior wall of the vent tube 42 may be free of ink or other fluid, which may prevent concerns (e.g., clogging, obstacles, suboptimal venting) with the one-way valve 54, by coupling the vent tube, second insert 34 and one-way valve before prior to insertion of the vent tube into the ink stored in the ink replenishing bottle 22.

As can be seen in FIGS. 3 and 4, during use, as ink is drained from the ink replenishing bottle 22 to the ink supply tank 50, the volume of ink drained is replaced by air flowing through the one-way valve 54, second insert 34 and vent tube 42 into the enclosed reservoir 27 of the ink replenishing bottle. Preferably, the vent tube 42 is sufficiently long to transfer the incoming air through the ink remaining in the bottle without the air flowing through the ink, with the air exiting the vent tube above the ink line 58 where it does not enter into or bubble through the ink. Accordingly, the bottle apparatus 20 is configured to prevent air ingress directly into the ink or liquid within the bottle 22, even when the ink or fluid is being transferred out of the bottle. This avoids the problem of air bubbles introduced in the ink that may create missing jets in the print heads and recovery problems, as well understood by a skilled artisan. This also minimizes concerns with toxic fumes that may come from oxidation of the ink created by air bubbles flowing through the ink.

The ink replenishing bottle 22 is a multi-purpose bottle configured for a plurality of operations. For example, during one stage, the ink replenishing bottle may feed ink to the image forming device. During another stage the ink replenishing bottle may provide flushing fluid to the image forming device to clean items of the device that may get dirty or otherwise contaminated from use. In an effort to reduce redundancy in the disclosure, it is understood that flushing fluid may be transferred to supply tanks or directly to cleaning stations of the image forming system 10 as discussed herein with respect to ink being supplied to image forming devices. Further, during yet another stage the ink replenishing bottle may collect waste (e.g., residual components of ink and web debris diluted or suspended in flushing fluid) from the image forming device.

Figure 5:
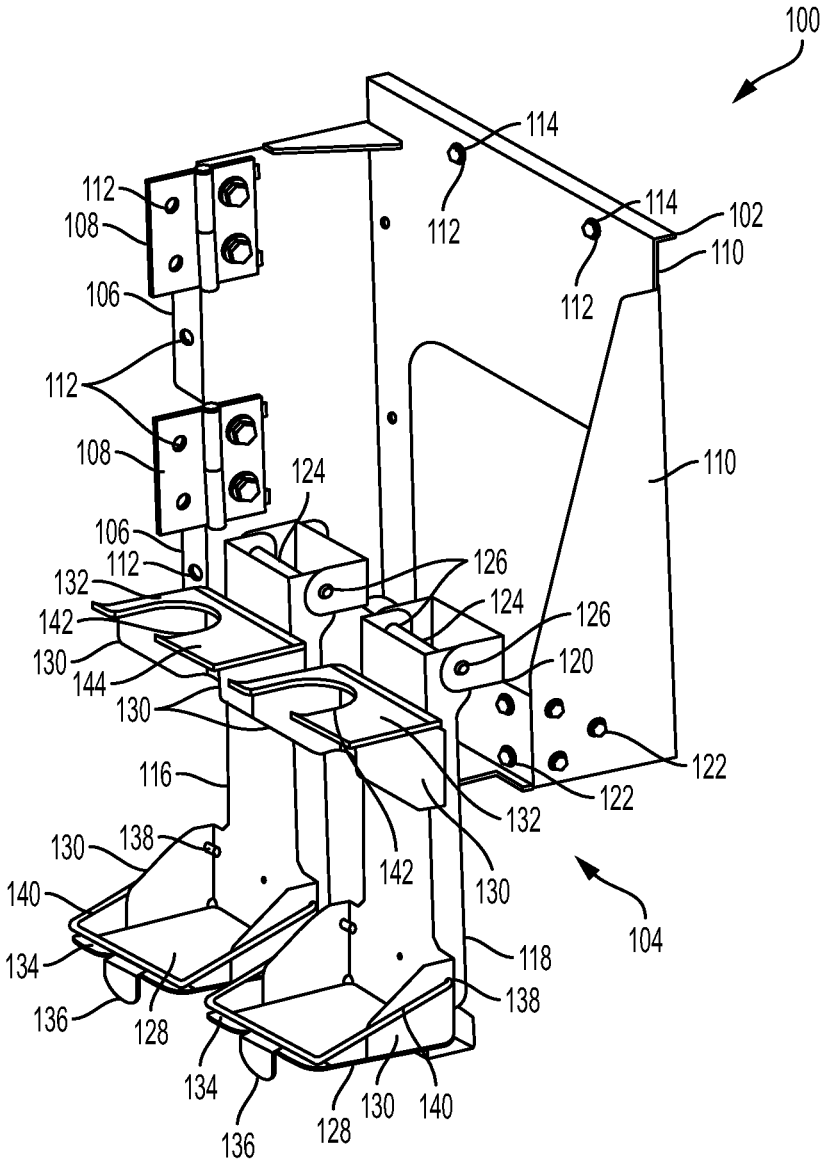
FIG. 5 shows a bottle loading mechanism in accordance with an exemplary embodiment.

In order to support the ink replenishing bottle during use, a bottle loading mechanism may be provided adjacent or as part of the image forming device. FIG. 5 depicts an exemplary bottle loading mechanism 100 typically made of metal or other durable, rigid, strong material. The bottle loading mechanism may include a support frame 102, and a rack 104 attached to the support frame. The support frame 102 may be configured as a stand-alone support, or may attach to another structure, such as an image forming device or another structure adjacent the image forming device to support fluid transfer between at least one multi-purpose bottle apparatus 20 and the image forming device. By way of example, the support frame may include frame attachment points including flanges 106, brackets 108 and frame walls 110 having bores 112 that may accept fasteners 114 (e.g., screws, bolts, nails) for attaching the support frame to another structure, as well understood by a skilled artisan.

The rack 104 includes first a bottle holder 116 configured to secure an ink replenishing bottle 22 thereto, with the ink replenishing bottle designed to store ink therein for transfer to the ink supply tank 50 (FIG. 4). While not being limited to a particular theory, the rack 104 may also include a second bottle holder 118 configured to secure another bottle 22 thereto. The bottle secured to the second bottle holder 118 may include the same ink as contained in the ink replenishing bottle secured to the first bottle holder 116 or another ink for use by the image forming device. Alternatively the bottle secured to the second bottle holder may hold in its reservoir 27 another fluid for use by the image forming device, such as flushing fluid for transfer to the image forming device, the media post-processing device 16, the media output receptacle 18, the continuous feed media source 12 or other structure associated with image forming devices that may get dirty or otherwise contaminated from use, as well understood by a skilled artisan.

The bottle loading mechanism 100 is configured to rotate ink replenishing bottles 22 from an upright position with a closure 24 at the top of the ink replenishing bottle to an upside down gravity feed position with the closure at the bottom of the ink replenishing bottle to drain ink from the ink replenishing bottle with the aid of gravity. When in the gravity feed position, the bottles can supply about two liters of ink in eight minutes, for a flow rate of about 0.25 L/min. While the invention is not limited to any particular flow rate, the inventors have discovered that a flow rate of between 0.10 L/min and 1.0 L/Min, and more particularly about 0.25 L/min provides adequate ink flow to the ink supply tanks 50 to provide optimal image quality over extended run times while the image forming device is operating. A pump (not shown) may also be used to draw fluid (e.g., ink, flushing fluid) from the ink replenishing bottles 22 to supply tanks 50 of the image forming devices.

The support frame 102 includes a pivot support 120 attached to side frame walls 110 of the support frame, for example, via an L-shaped bracket (not shown) coupled to fasteners 122 with the pivot support and side frame walls secured there between. The bottle holders 116, 118 are pivotally mounted to the pivot support 120, here with the aid of pivot support shafts 124 extended through matching apertures 126 of the bottle holders and pivot support. The pivot support shafts 124 and matching apertures 126 are one of a plurality of approaches for rotatably coupling the bottle holders 116, 118 to the support frame 102, with other approaches within the scope of the invention as readily understood by a skilled artisan.

As noted above, the bottle holders 116, 118 are both configured to secure an ink replenishing bottle 22 thereto. The shape and size of the bottle holders is not limited to any particular configuration, as long as the bottle holder is intentionally designed to hold a bottle 22 both upright or upside down without the bottle falling out in either position or while rotating between the upright and upside down positions. Still referring to FIG. 5, each exemplary bottle holder 116, 118 includes a base section 128, side walls 130 and a top wall 132 designed to hold the bottles. The base sections 128 may include supporting flanges 134 to help secure the bottles, and may further include handles or tabs 136 for a user to grab for aid in rotating the bottle holders 116, 118.

While not being limited to a particular theory, each bottle holder 116, 118 may also include a wire retainer 140 pivotally attached to side walls 130 of the bottle holders via insertion through bores 138 in the side walls. The wire retainers 140 provide additional support to hold the bottles 22 securely, especially when the bottles are upside down or rotating to any ink dispensing, fluid dispensing, or fluid collecting position. It is understood that the ink dispensing and fluid dispensing positions refer to an orientation of the bottle intentionally designed to provide fluid egress from the bottle with aid from gravity or another force (e.g., pump). In addition, the fluid collecting position refers to an orientation of the bottle intentionally designed for fluid ingress.

The top walls 132 have a cut-away portion defining a bottle neck receiving edge 142 configured to receive the bottles 22, preferably about the bottle neck 25 of the bottle below the closure 24. In this configuration, the top wall 132 may serve as a support member for the bottles 22 regardless of the orientation of the bottles and bottle holders. For example, the bottle neck receiving edge 142 and top wall 132 may contact and support: the bottles 22 when the bottles are upside down in an ink or fluid dispensing position, the closure 24 when the bottles are upright, and the bottle neck 25 during rotation of the bottles.

Still referring to FIG. 5, labels 144 may be placed on the top walls 132 with indicia corresponding to the contents within a respective bottle used with the bottle holders 116, 118. For example, a label bearing indicia "INK MICR BLACK" may be attached to the top wall 132 of the bottle holder 116, preferably via an adhesive there between. Similarly, a label bearing indicia "Flushing Fluid" may be attached to the top wall 132 of the bottle holder 118, also preferably via an adhesive there between. In other applications, a label 144 may use other forms of identification as indicia of bottle contents preferred in that bottle holder. That is, a label 144 having a predetermined color or other marking may be used to identify the preferred contents as a specific ink corresponding to the color or type of marking. Such labeling helps users when replacing empty bottles 22 with replacement bottles.

Figure 7:
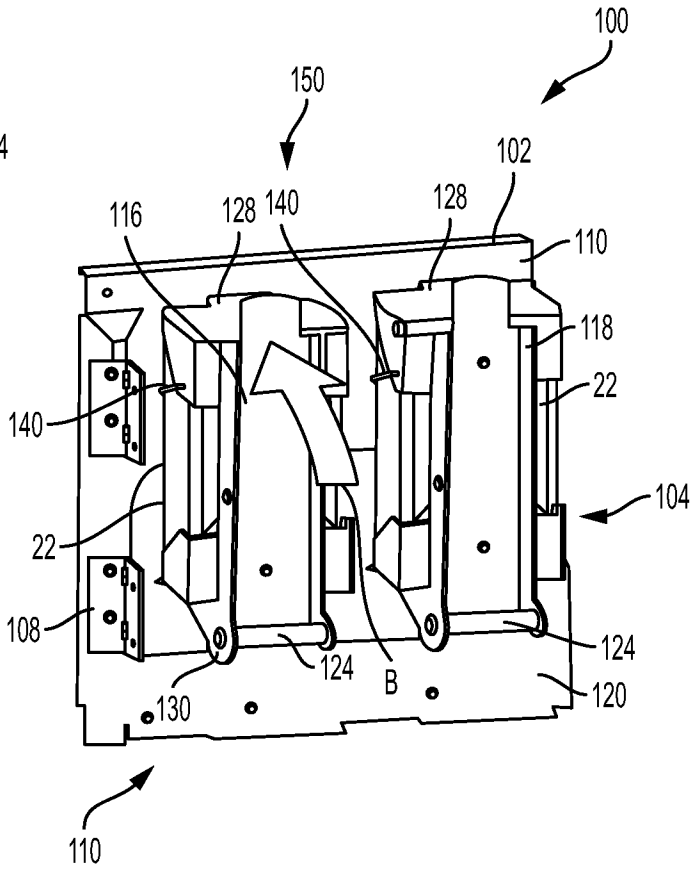
FIG. 7 shows the bottle loading mechanism and quick connect gravity feed multipurpose bottle apparatus of FIG. 6 with the bottle apparatus upside down in a gravity feed position.
Figure 6:
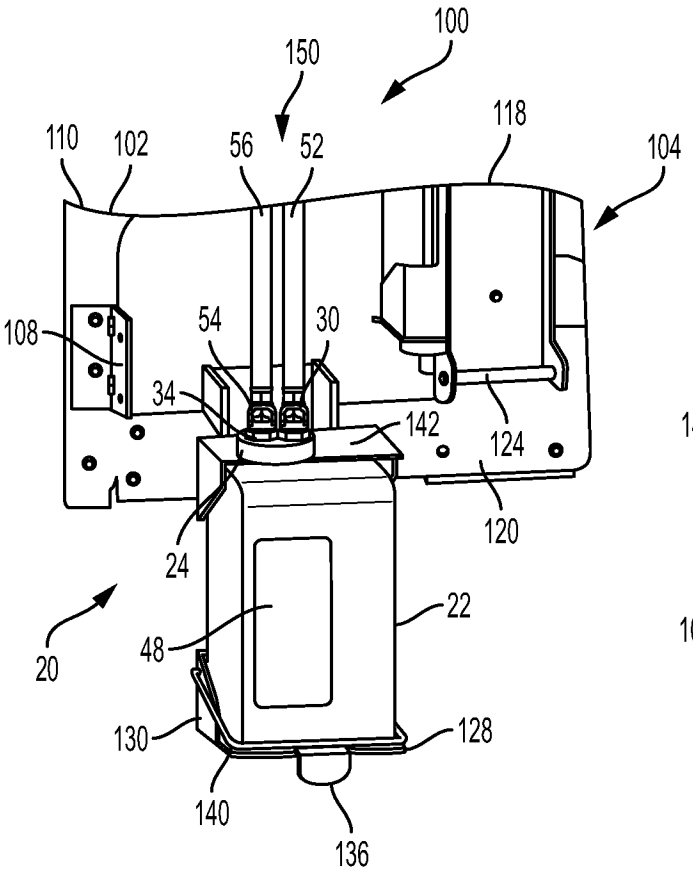
FIG. 6 shows the bottle loading mechanism of FIG. 5 and the quick connect gravity feed multipurpose bottle apparatus of FIG. 2 in an upright position.

FIGS. 6 and 7 depict an exemplary approach for feeding ink or flushing fluid to a supply tank 50 of an image forming device (e.g., media marking device 14, inkjet image forming device, inkjet printer, lithography image forming device, lithography printer). An ink delivery system 150 includes a bottle loading mechanism 100 having the support frame 102 and rack 104, with the rack including bottle holders 116, 118. The bottle holder 116 is shown holding an ink replenishing bottle 22 thereto, and the bottle holder 118 holding a bottle 22 of fluid flush. It is understood that the bottle contents are not limited to the example shown in FIGS. 6 and 7, and that the correlation between the bottle holders and bottle contents is merely one example within the scope of the invention.

As can be seen in FIG. 6, the bottle holder 118 is holding bottle 22 upside down in a gravity feed position to transfer fluid flush to the image forming device, the media post-processing device 16, the media output receptacle 18, the continuous feed media source 12 or other structure associated with image forming devices that may get dirty or otherwise contaminated from use. In this gravity feed position, the bottle 22 storing fluid flush was previously loaded onto the bottle holder 118, and rotated by the bottle holder from its upright loading position to the gravity feed position shown in FIGS. 6 and 7. It is understood that the bottle apparatuses 20 used for the ink feed and the fluid flush stages are preferable substantially similar, with a primary difference being the type of fluid held in the bottle and transferred to the image forming device. For example, the bottle 22 containing fluid flush has one of its quick connect fittings 30, 34 attached to a tube (not pictured) for transporting the flushing fluid to the image forming system 10. Still referring to FIG. 6, the bottle holder 116 is shown holding the ink replenishing bottle 22 in an upright position useful for loading and unloading the bottle, with the quick connect fitting 30 attached to conduit 52, and the quick connect fitting 34 attached to the fluid conduit 56 with the one-way valve 54 therein to inhibit fluid ingress into the bottle.

FIG. 7 depicts the ink delivery system with the bottle holder 116 rotated (e.g., arrow B) from its bottle loading position shown in FIG. 6 to move the ink replenishing bottle 22 from the upright position to an upside down fluid delivery position with the closure 24 at the bottom of the ink replenishing bottle. In this fluid delivery position, which is also shown in FIGS. 3 and 4, the ink stored in the ink replenishing bottle 22 has its top surface at ink line 58 in direct contact with the air in the ink replenishing bottle, and the ink is positioned for transfer through the closure 24, the quick connect fitting 30 and the conduit 52 to the ink supply tank 50. As ink is fed from the reservoir 27 of the bottle 22, air, preferably ambient, flows through conduit 56, the one-way valve 54, and the vent tube 42 without introducing air bubbles into the ink that may create missing jets in the print heads of the image forming device, toxic oxidation of the ink and recovery problems as well understood by a skilled artisan.

The rotation of the bottle holder 116 from its upright position (FIG. 6) to its gravity feeding position (FIG. 7) also pivots the wire retainer 140 to secure the bottle 22. As can be seen in FIG. 6, the wire retainer 140 rests on the base section 128 of the bottle holder 116. As the ink replacement bottle 22 is rotated to an upside down gravity feed position (FIG. 7) via the bottle holder 116, the wire retainer 140 pivots away from the base section 128 for contact with the bottle to prevent the bottle from sliding out of the bottle holder 116. Slowly rotating the bottle to the upside down gravity feed position inverts settled material to the top position. Ink flowing out the quick connect fitting 30 and the delivery tube (e.g., conduit 52), now from the bottom, may move at a rate of about 0.25 L/min. This flow within the tube may create a swirling motion at less than about 60 rpm to gently stir the ink within the reservoir 27.

The scope of the invention also includes the removal and reuse of the bottles 22. For example, after rotating the bottle holder 116 from the gravity feed position (FIG. 7) back to the upright position (FIG. 6) upright with the closure at the top of the ink replenishing bottle 22, the conduits 52 and 56 may be removed from the quick connect fittings 30 and 34 respectively. One of the quick connect fittings 30, 34 can then be connected to a conduit (not shown) in fluid communication with a waste collect of the image forming device for transfer of waste from the waste collect to the ink replenishing bottle 22. In other words, the ink replenishing bottle may be reused as waste ink containers and collect waste (e.g., residual components of ink and web debris diluted or suspended in flushing fluid) from the image forming device. When the ink replenishing bottle 22 is being used as a waste ink container with one of its quick connect fittings 30, 34 connected to a conduit in fluid communication with the waste collect, the other quick connect fitting may be available for use as a fluid tube to allow air in the bottle to escape as waste flows into the bottle.

The scope of the invention also includes the removal and refilling of the bottles 22. For example, after rotating the bottle holder 116 from the gravity feed position (FIG. 7) back to the upright position (FIG. 6) upright with the closure at the top of the ink replenishing bottle 22, the conduits 52 and 56 may be removed (e.g., pulled apart, unscrewed, detached) from the quick connect fittings 30 and 34 respectively to provide the bottle apparatus 20 for refilling. The one-way valve may be disconnected from its direct or indirect coupling to the quick connect fitting 34 by separating the valve and fitting to allow venting out of the bottle via the fitting during liquid refilling. At this time the quick connect fittings 30, 34, and in particular the quick connect fitting 30 should be cleaned to ensure fluid bypass there through. The quick connect fitting 30 may then be attached to a liquid source (e.g., tank, reservoir, container) storing the liquid, for example via a conduit providing fluid communication between the quick connect fitting 30 and the liquid source (not shown). Then the bottle 22 may be refilled with the liquid from the liquid source via the first quick connect fitting. A pump, gravity, or other pressure applicator may be useful to aid in the transfer of the liquid from the liquid source to the bottle. After the bottle 22 is refilled, the quick connect fitting 30 is disconnected from the liquid source, for example, by separating the conduit providing fluid communication to the liquid source from the fitting. Then, for use of the bottle apparatus 20 as described above, a one-way valve (or the used one-way valve if operable) may be reattached to the quick connect fitting 34.

It will be appreciated that the above-disclosed and other features and functions, or alternatives thereof, may be desirably combined into many other different systems or applications. For example, alternatives for the vent tube 42 may be used to infeed air through the fluid (e.g., ink, flushing fluid) contained in the bottles 22, such as, for example, a tunnel along the interior of the bottle from an opening in communication with the quick connect fitting 34 or conduit 56 to a second opening adjacent the bottom wall 44 of the bottle. Also, various presently unforeseen or unanticipated alternatives, modifications, variations or improvements therein may be subsequently made by those skilled in the art.

What is claimed is:

1. A method in a printer liquid delivery system for supplying a liquid useful in printing to a liquid supply tank of an image forming device, the printer liquid delivery system including a bottle loading mechanism having a support frame and a rack attached to the support frame, the rack including a bottle holder rotatably coupled to the support frame and configured to secure a printer liquid replenishing bottle thereto, the method comprising:

securing the printer liquid replenishing bottle to the bottle holder, the printer liquid replenishing bottle storing the liquid and air therein;

rotating the bottle holder about a pivotal mount rotatably coupling the bottle holder to the support frame to move the printer liquid replenishing bottle from a first position upright with a closure of the printer liquid replenishing bottle at the top of the printer liquid replenishing bottle to a second position upside down with the closure at the bottom of the printer liquid replenishing bottle, the liquid stored in the printer liquid replenishing bottle in the second position having a body and a top layer in direct contact with the air in the printer liquid replenishing bottle;

transferring liquid from the printer liquid replenishing bottle via the closure to the liquid supply tank;

replacing the liquid transferred from the printer liquid replenishing bottle by introducing ambient air to the air in the printer liquid replenishing bottle without direct contact of the ambient air into the body of liquid in the printer liquid replenishing bottle; and wherein the step of rotating the bottle holder about a pivotal mount rotatably coupling the bottle holder to the support frame to move the printer liquid replenishing bottle from a first position upright with a closure of the printer liquid replenishing bottle at the top of the printer liquid replenishing bottle to a second position upside down with the closure at the bottom of the printer liquid replenishing bottle automatically pivots a bottle retainer pivotally attached to the bottle holder to contact the printer liquid replenishing bottle and secure the printer liquid replenishing bottle to the bottle holder.

2. The method of claim 1, further comprising:

rotating the bottle holder from the second position back to the first position upright with the closure at the top of the printer liquid replenishing bottle; and transferring waste from a waste collect of the inkjet image forming device to the printer liquid replenishing bottle.

3. The method of claim 2, the printer liquid replenishing bottle having an enclosed reservoir configured to house the liquid with the closure sealingly coupled to the reservoir, the closure having a first port and a second port separate from the first port, the first port of the closure having a first quick connect fitting sealingly connected thereto for fluid communication with the liquid supply tank of the image forming device to allow egress of the liquid from the printer liquid replenishing bottle to the liquid supply tank, the second port of the closure having a second quick connect fitting sealingly connected thereto to allow fluid ingress only into the printer liquid replenishing bottle without fluid flow through the liquid housed in the printer liquid replenishing bottle, the step of transferring liquid from the printer liquid replenishing bottle to the supply tank including transferring the liquid via the first quick connect fitting, the step of replacing the liquid transferred from the printer liquid replenishing bottle including introducing ambient air to the air in the printer liquid replenishing bottle via the second quick connect fitting, and the step of transferring waste from a waste collect of the image forming device to the printer liquid replenishing bottle including transferring the waste via the second quick connect fitting and venting air out of the printer liquid replenishing bottle via the first quick connect fitting.

4. The method of claim 1, the printer liquid replenishing bottle having an enclosed reservoir configured to house the liquid with the closure sealingly coupled to the reservoir, the closure having a first port and a second port separate from the first port, the first port of the closure having a first quick connect fitting sealingly connected thereto for fluid communication with the liquid supply tank of the image forming device to allow egress of the liquid from the printer liquid replenishing bottle to the liquid supply tank, the second port of the closure having a second quick connect fitting sealingly connected thereto to allow fluid ingress only into the printer liquid replenishing bottle without fluid flow through the liquid housed in the printer liquid replenishing bottle, the step of transferring liquid from the printer liquid replenishing bottle to the liquid supply tank including transferring the liquid via the first quick connect fitting, and the step of replacing the liquid transferred from the printer liquid replenishing bottle including introducing ambient air into the printer liquid replenishing bottle via the second quick connect fitting.

5. The method of claim 4, the second conduit further comprising a vent tube attached to the second quick connect fitting and extending into the printer liquid replenishing bottle via the second port, the vent tube having an aperture adjacent the bottom wall of the enclosed reservoir, the vent tube coupled to a one-way valve configured for fluid ingress only into the printer liquid replenishing bottle, wherein the step of replacing the liquid transferred from the printer liquid replenishing bottle further includes introducing ambient air into the printer liquid replenishing bottle via the vent tube without introducing air bubbles into the liquid remaining in the printer liquid replenishing bottle.

6. The method of claim 1, the step of transferring liquid further comprises transferring the liquid as toxic fume emitting liquid from the printer liquid replenishing bottle via the closure to the liquid supply tank.

7. The method of claim 2, wherein the step of rotating the bottle holder from the second position back to the first position upright with the closure at the top of the printer liquid replenishing bottle automatically pivots a bottle retainer pivotally attached to the bottle holder away from contact with the printer liquid replenishing bottle for removal of the printer liquid replenishing bottle from the bottle holder.

* * * * *